US006948205B2

(12) United States Patent
Van Der Wurf et al.

(10) Patent No.: US 6,948,205 B2
(45) Date of Patent: Sep. 27, 2005

(54) MATTRESS, PROVIDED WITH SPRING ELEMENTS, SUCH AS COIL SPRINGS

(75) Inventors: Cornelus Johannes Van Der Wurf, Antwerpen (BE); Irene Clementine Mirjam Best, Herwen (NL)

(73) Assignee: Beter Bed Holding N.V., Uden (NL)

( * ) Notice: Subject to any disclaimer, the term of this patent is extended or adjusted under 35 U.S.C. 154(b) by 0 days.

(21) Appl. No.: 10/433,705

(22) PCT Filed: Jan. 4, 2002

(86) PCT No.: PCT/NL02/00004

§ 371 (c)(1),
(2), (4) Date: Aug. 18, 2003

(87) PCT Pub. No.: WO02/065879

PCT Pub. Date: Aug. 29, 2002

(65) Prior Publication Data

US 2004/0025258 A1 Feb. 12, 2004

(30) Foreign Application Priority Data

Jan. 5, 2001 (NL) ..... 1017038

(51) Int. Cl.[7] ..... A47C 27/20
(52) U.S. Cl. ..... 5/718; 5/719; 5/720
(58) Field of Search ..... 5/718–720, 727, 5/729, 730, 740

(56) References Cited

U.S. PATENT DOCUMENTS

| | | | | | |
|---|---|---|---|---|---|
| 3,099,021 | A | * | 7/1963 | Wetzler | 5/718 |
| 3,310,819 | A | | 3/1967 | Morrison | |
| 3,623,171 | A | * | 11/1971 | Arkin | 5/718 |
| 3,732,586 | A | * | 5/1973 | Frey | 5/718 |
| 4,110,881 | A | * | 9/1978 | Thompson | 29/91.1 |
| 4,862,540 | A | * | 9/1989 | Savenije | 5/718 |
| 5,960,496 | A | * | 10/1999 | Boyd | 5/722 |
| 5,960,497 | A | * | 10/1999 | Castellino et al. | 5/730 |

FOREIGN PATENT DOCUMENTS

| | | |
|---|---|---|
| EP | 0426261 | 5/1991 |

* cited by examiner

*Primary Examiner*—Michael Trettel
(74) *Attorney, Agent, or Firm*—Anthony H. Handal; Kirkpatrick and Lockhart Nicholson Graham LLP

(57) ABSTRACT

The present invention relates to a mattress (10), for use as a bed, which mattress comprises substantially resilient material such as a foam rubber, spring devices (4) such as coil springs being provided in the mattress, in order to distribute the pressure exerted upon the mattress. The mattress according to the invention is characterised in that the mattress comprises at least two layers (1,2) placed one on top of the other, blind holes (3) for the accommodation of the spring devices (4) being made in at least one of said two layers, which blind holes connect to the boundary face between the two layers.

20 Claims, 4 Drawing Sheets

MATTRESS, PROVIDED WITH SPRING ELEMENTS, SUCH AS COIL SPRINGS

The invention relates to a mattress, for use as a bed, which mattress comprises substantially resilient material such as a foam rubber, spring devices such as coil springs being provided in the mattress, in order to distribute the pressure exerted upon the mattress.

For the purpose of clarity, it is pointed out that the term "mattress" in the present text is intended to convey substantially resilient elements for use as a bed, cushion, chair or comparable objects.

A mattress according to the type mentioned in the preamble is known in the prior art. According to the prior art, it is known to bore from the top side of the mattress, using a drill that resembles an apple corer, and remove a usually round cylindrical part from the mattress. After the removal of this cylindrical element, a spring element, such as a coil spring, is screwed into the blind hole formed in this way in the material of the mattress, the entire spring element being concealed in the material of the mattress. The blind hole is subsequently closed up again with the cylindrical part originally removed.

The fitting of the spring devices according to the prior art has a number of disadvantages. First, at least one side of the mattress has to be damaged over a great part of its surface, in order to be able to fit the spring devices in the material of the mattress. Secondly, the functioning of the spring devices fitted in the material of the mattress is limited. The spring elements are in fact enclosed on all sides by the material of the mattress, so that a major part of the spring characteristic is determined by the material of the mattress, and a user cannot adjust the spring characteristic of the spring elements as desired.

It is the object of the present invention to provide a mattress of the type mentioned in the preamble, in the case of which the disadvantages indicated above are avoided as far as possible.

That object is achieved according to the invention by the fact that the mattress comprises at least two layers provided one on top of the other, blind holes for the accommodation of the spring devices being provided in at least one of said two layers, which blind holes connect to the boundary face between the two layers.

In this case it is possible for the blind holes to be made in each of the two layers.

By constructing the mattress from a first layer and a second layer, it is possible to form a mattress that is free from damage both on the top side and on the bottom side. A boundary face that extends up to the side edges of the mattress will be present between the two layers of material. The boundary face can be seen and also felt on said side edges of the mattress. Since a user does not come into contact with said side edges of the mattress, the presence of such a boundary face during use is not a problem.

By means of the abovementioned measures, it is further ensured that the spring devices extend in a channel made in the mattress. In other words, the spring devices are not enclosed on all sides by the material of the mattress, and can therefore perform their spring action better.

It appears from research carried out by the applicant that fitting the spring devices in the manner described above ensures that the pressure distribution that is exerted upon the body of a user is better than that in the case of mattresses according to the prior art.

According to the invention, it is further possible for the blind holes in the first layer to connect to the blind holes in the second layer, in order to form channels in the mattress that extend through both the first and the second layer.

By means of this measure it is possible for spring devices that extend in both layers of the mattress to be placed in the mattress. Through the presence of the blind holes in the two layers, the spring devices are enclosed on both their sides in the material of the mattress.

According to the invention, it is further possible for the first layer to comprise a first material and the second layer to comprise a second material, the first material and the second material being different from each other.

By means of this measure it is possible to vary the sleeping comfort experienced by the user, simply by turning over the mattress. By using two different types of materials, the mattress can acquire a top side and a bottom side with differing levels of comfort.

It is also possible by this measure to provide the mattress with a first side which forms the top side of the mattress when it is in use. That means that a user makes contact only with that top side. That top side can be made of a more expensive material, which has greater comfort requirements than the material forming the bottom side of the mattress. Through the use of two materials, a saving can be made on the production costs of the mattress according to the invention.

According to the invention, it is possible for at least one of the layers to comprise slow foam.

In the present text the term "slow foam" is intended to convey a type of plastic material. An example of a material that can be used for the mattress according to the invention is slow foam V50.

In order further to improve the distribution of the pressure that is exerted upon the top side of the mattress, it is possible for notches to be made in the slow foam on the outside of the mattress, which notches extend in the longitudinal direction and/or the transverse direction of the mattress. It is possible here for the notches to extend along a length of approximately 40 mm.

It is also possible according to the invention for at least one of the layers to comprise polyester.

If there is a desire to provide the mattress with a genuine bottom side and a genuine top side, it is possible to make the bottom side of a relatively cheap material. The comfort requirements to be made of this material will be less than the requirements to be made of the top side. A suitable layer that could be used for the bottom side is a cold foam of the code name SG45110, commonly used in the prior art.

It is possible according to the invention for spring devices to be distributed over the mattress, the spring characteristic of the springs varying along the length of the mattress.

When the mattress is in use, a person will exert pressures of different magnitudes upon different points of the mattress. For instance, more pressure will be exerted upon the mattress at the level of the hips than at the level of the feet. By means of the abovementioned measure it is possible to adapt the spring characteristic of the springs used in such a way that optimum pressure distribution is experienced along the longitudinal direction of the mattress. It is possible in this case for the mattress to comprise a head end specifically intended for that purpose and a foot end specifically intended for that purpose.

It is further possible according to the invention for the spring devices to comprise a spring element such as a coil spring, and a shock absorber that is operatively connected to the spring element.

As already indicated above, through the presence of open channels in the mattress it is possible to make optimum use of the spring characteristics of the spring devices used. The distribution of the pressure over the surface of the mattress can be improved further by constructing the spring devices from a spring element such as a coil spring, combined with a shock absorber. The good pressure distribution that can be achieved by means of the spring devices in the shock absorbers means that it is possible for the comfort experienced by the user to increase further. The chance of damage to or irritation of the skin or other parts of the human body caused by excessive local pressure on the skin is substantially reduced by the presence of the spring devices according to the invention discussed above.

According to a first embodiment, it is possible for the shock absorber to be designed in the form of a substantially continuous element of resilient material, such as a foam rubber. It is possible here for the shock absorber to comprise polyether. As an alternative, it is possible for the shock absorber to comprise a rubber element. The shock absorber can also comprise an air cylinder.

The use of the various embodiments of the shock absorbers will depend on the pressure distribution that one desires to achieve in the mattress.

It is further possible according to the invention for the spring devices to comprise dish-shaped end elements on their ends. In this case the shock absorber can be fixed at both its ends to the end elements of the spring devices.

The presence of the end elements will help to ensure that the spring elements and/or the shock absorbers cannot exert local pressure upon the material of the mattress. Through the presence of the end elements, the pressure is always distributed over a surface area that corresponds at least to the surface area of the end element itself. For good functioning of the shock absorbers of the spring devices, it is desirable for the ends of the shock absorbers to be fixed at a specific place in the mattress. The shock absorbers can be fixed at both ends to the end elements, and by way of the end elements can act upon the material of the mattress.

When the mattress is in use, at least the top surface of the mattress will deform under the pressure exerted upon it by a user. It is therefore advantageous for the shock absorber to be hingedly connected to at least one of the end elements of the spring devices.

Just as stated above with reference to the variation of the spring characteristics, it is possible according to the invention to vary the spring characteristic of the shock absorber along the length of the mattress.

In a second aspect, the invention is aimed at a spring device, for use in a mattress according to one of the preceding claims, the spring device comprising a spring element such as a coil spring, and a shock absorber that is operatively connected to the spring element.

The present invention further relates to a method for producing a mattress, for use as a bed, the mattress being made of substantially resilient material such as foam rubber, and spring devices such as coil springs being fitted in the mattress, for the distribution of pressure exerted upon the mattress.

The method according to the invention is characterized in that the mattress is constructed of at least two layers placed one on top of the other, blind holes being made in at least one of the layers, and spring elements being provided in the blind holes, after which the blind holes are covered by the second layer of the mattress. The method according to the present invention is further improved by the fact that blind holes are provided in both a first and a second layer of the mattress, and spring devices are subsequently provided in the blind holes of the first layer of the mattress, the spring devices then being covered by the second layer of the mattress, so that the blind holes of the first layer of the mattress lie in line with the blind holes of the second layer of the mattress.

The invention will be described further with reference to the appended figures, in which.

Figure 1:
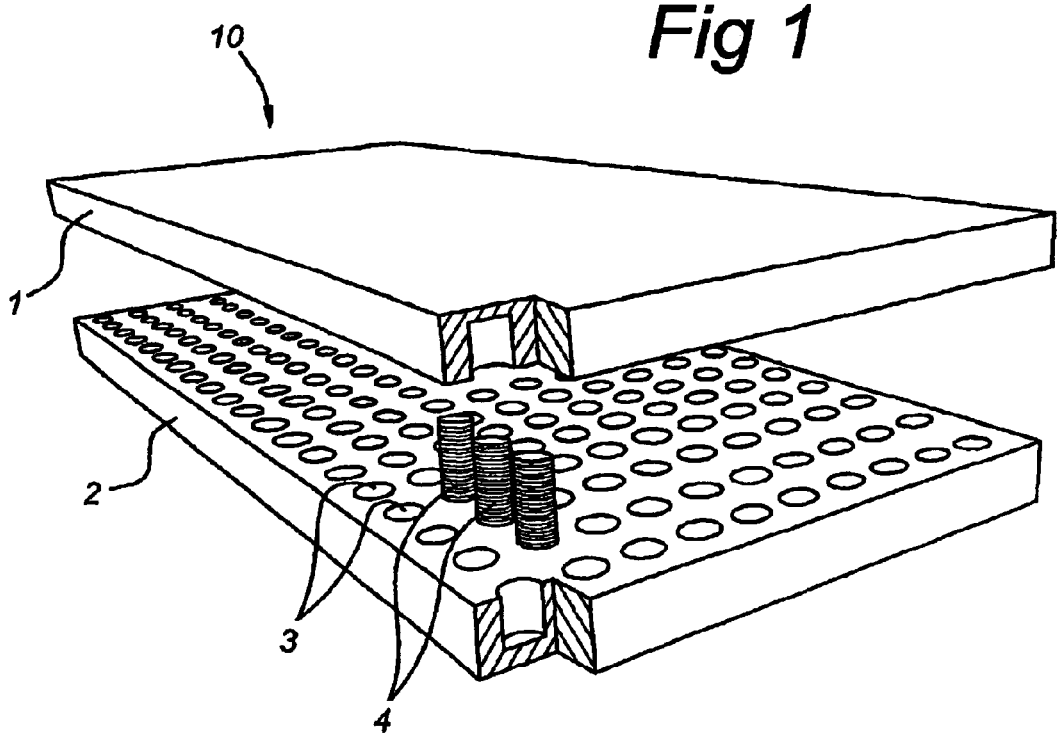
FIG. 1 shows a view of the mattress according to the invention, in which the first layer of the mattress is separate from the second layer of the mattress.

FIG. 1 shows the mattress 10 according to the invention. The mattress 10 comprises a first layer or top layer 1, which is fixed on a second layer or bottom layer 2 when the mattress is in use. In FIG. 1, for the sake of clarity, the layers 1, 2 are illustrated at a distance from each other. Blind holes 3 for the accommodation of spring devices 4 are provided in each of the layers 1, 2. A possible embodiment of said spring devices is discussed further with reference to FIG. 3 and the figures following it. The blind holes 3 are provided in such a way in the first layer 1 and the second layer 2 respectively that the blind holes 3 in the first layer 1 connect to the blind holes 3 in the second layer 2. This means that the blind holes of the combined layers 1 and 2 together form channels that extend over substantially the entire thickness of the mattress.

It can further be seen in FIG. 1 that the top side of the mattress, in other words the top side of the layer 1, forms a smooth surface. The top side is therefore not damaged, which means that the user cannot feel any edges, uneven parts and the like on the top side of the mattress.

The mattress 10 according to the invention can be made in such a way that the material of the first layer 1 differs from the material of the second layer 2. A plastic with a high degree of comfort, for example, is used for the first layer 1. An example of a suitable plastic is slow foam. This plastic is relatively expensive. For the second layer 2, a different plastic can be used, one that is also suitable for a mattress, but in the case of which the comfort level can be lower, without the overall comfort of the mattress 10 being adversely affected. Polyester can be used as the material for the second layer 2.

A suitable material for the first layer 1 is, for example, slow foam F50. This material can be provided in any desired thickness, but it preferably has a thickness of approximately 8 cm. The bottom layer 2 can be made of, for example, polyester cold foam SG45. Said second layer 2 can also be made in any suitable thickness. The bottom layer 2 is, for example, made in a thickness of 10 cm.

The presence of the spring devices 4 in the mattress 10 according to the invention makes it possible to obtain a better pressure distribution of the pressure exerted upon the top side of the mattress than is possible in the prior art. A user will experience greater comfort as a result of this better pressure distribution. Greater comfort means, inter alia, that users with back and neck complaints are less subject to sleep disturbances.

Research carried out at the Erasmus University in Rotterdam has shown that a good pressure distribution can lead to improved comfort.

In the prior art it is usual to measure the pressure that a user experiences from a mattress by means of a so-called ergo check. In the ergo check the load placed on the body is measured by means of a so-called measuring sheet. This is a substantially flat device in which finely distributed sensors are provided. Typically, 684 sensors are used in a measuring sheet, these sensors being distributed uniformly over the test surface. With the aid of this measuring sheet, the average pressure and the maximum pressure that the user experiences per $cm^2$ on the skin can be measured.

In the prior art it is usual for the pressure experienced by the body to be expressed in MmHg. By means of the mattress according to the invention, measurement results are achieved with an MmHg varying between 8.8 and 10.5 in the position when the user is lying on his/her back, while these values vary from 11.2 to 12.9 MmHg when the user is lying on his/her side.

Figure 2:
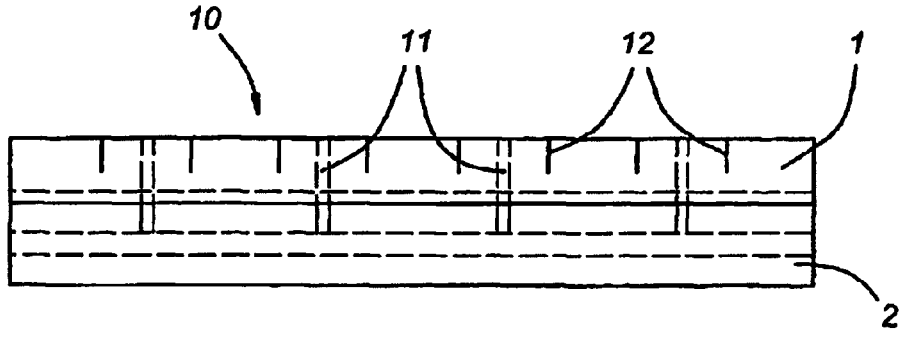
FIG. 2 shows a cross section of a possible embodiment of the mattress according to the invention.

FIG. 2 shows a cross section of a possible embodiment of the mattress 10 according to the invention. FIG. 2 shows a side view in cross section of the mattress. The mattress 10 according to FIG. 2 again comprises a first layer 1, which is supported by a second layer 2. The first layer 1 according to FIG. 2 is made of slow foam. Four holes 11 are made in the material over the width of the mattress 10. Said holes are used as air holes and have a diameter of typically 12 mm. In order further to improve the pressure distribution over the top surface of the slow foam, notches are made in the slow foam, which notches extend along the length of the mattress. Such notches can also extend in the transverse direction of the mattress (not shown). The notches 12 that are illustrated in FIG. 2 typically have a depth of 40 mm.

Figure 3:
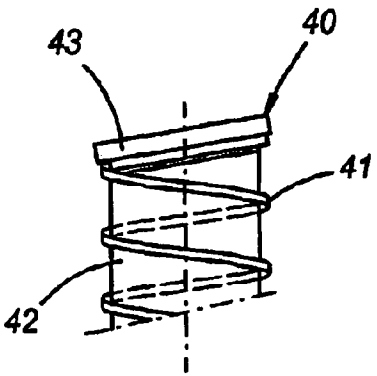
FIG. 3 shows a top part of a spring device for use in the mattress according to the invention.

FIG. 3 shows a top part of a first embodiment of a spring device 40 according to the present invention. The spring device 40 comprises a coil spring 41, which on the inside is filled with an element made of a foam rubber, such as polyether. The element is indicated by reference numeral 42. On the top side the spring device 40 is provided with a dish-shaped end element 43. Both the coil spring 41 and the foam rubber element 42 are fixed to this end element 43. The end element 43 acts as a tumbler. In other words, the end element 43 can follow deformations of the mattress. Through the presence of the end element 43, the material of the mattress in which the spring device 40 is provided is prevented from being loaded very locally, for example by the end of coil spring 41.

Figure 4:
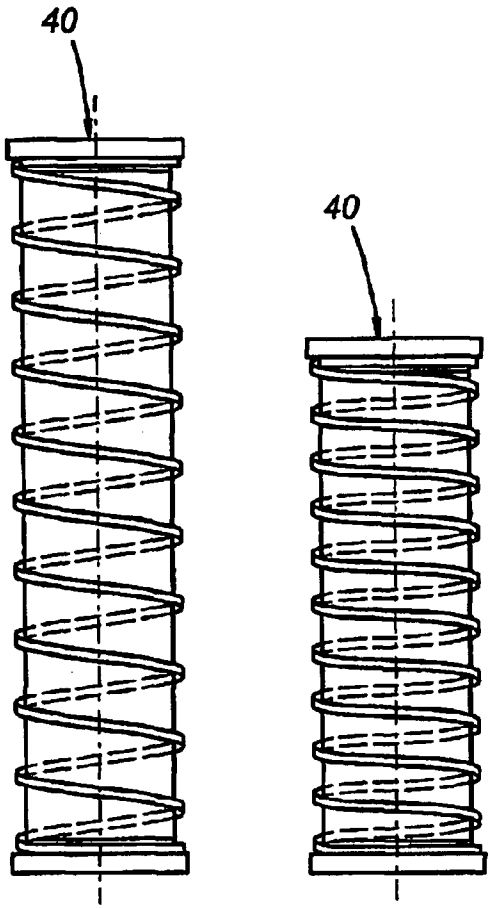
FIG. 4 shows the spring device according to FIG. 3 in an unloaded and a loaded state.

FIG. 4 shows the spring device 40 according to FIG. 3. FIG. 4 shows the spring device 40 in an unloaded state (on the left in the figure) and in a loaded state (on the right in the figure).

Figure 5:
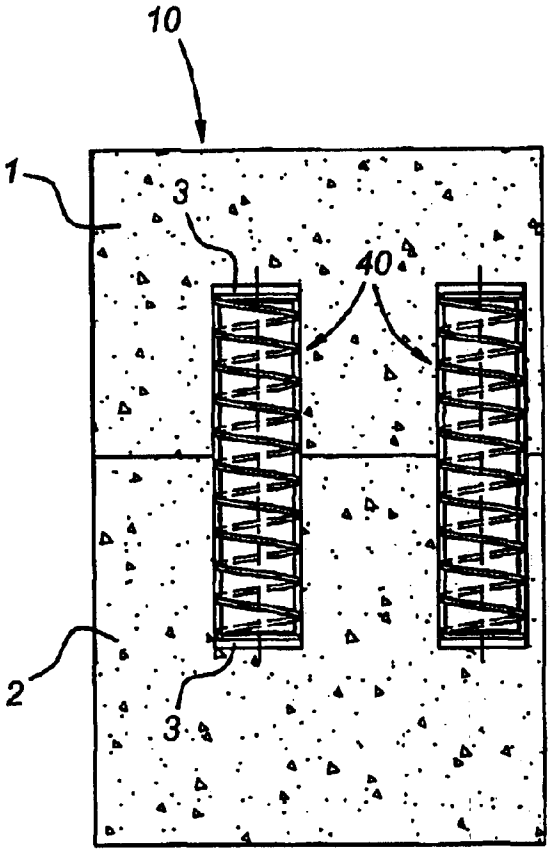
FIG. 5 shows a side view of a part of the mattress according to the invention, in which two spring devices according to FIGS. 3 and 4, which are accommodated in the material of the mattress, can be seen.

FIG. 5 shows a cross section of a part of a mattress 10 according to the invention, which mattress comprises a first layer 1 and a second layer 2, blind holes 3 being made in each of the layers, and the spring device 40 according to FIGS. 3 and 4 always being provided in the channel that is formed by a blind hole 3 in the first layer and a blind hole 2 in the second layer.

Figure 6:
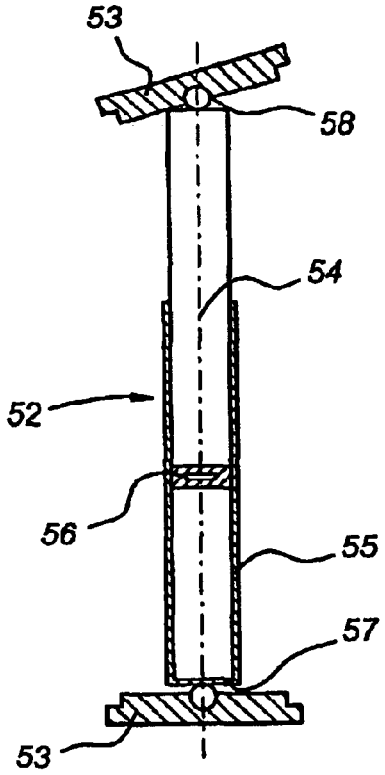
FIG. 6 shows a cross section of a shock absorber for use in the spring devices according to the invention, the shock absorber comprising an air cylinder.

FIG. 6 illustrates an alternative shock absorber 52, for use for a spring device according to the invention, which shock absorber 52 comprises an air cylinder. The shock absorber 52 is fixed at both ends to end elements 53. The shock absorber comprises a piston rod 54, which can move up and down in a cylinder 55. A piston element 56 is provided on the underside of the piston rod and connected in a close fit to the inside wall of the cylinder 55. For good functioning of the shock absorber, an air hole 57 is provided in the cylinder wall, near the bottom side of said wall. The shock absorber 52 according to FIG. 6 is connected by means of a snap closure to each of the end elements 53. The snap closure is indicated diagrammatically by the spherical element 58 on both ends of the shock absorber 52.

Figure 7:
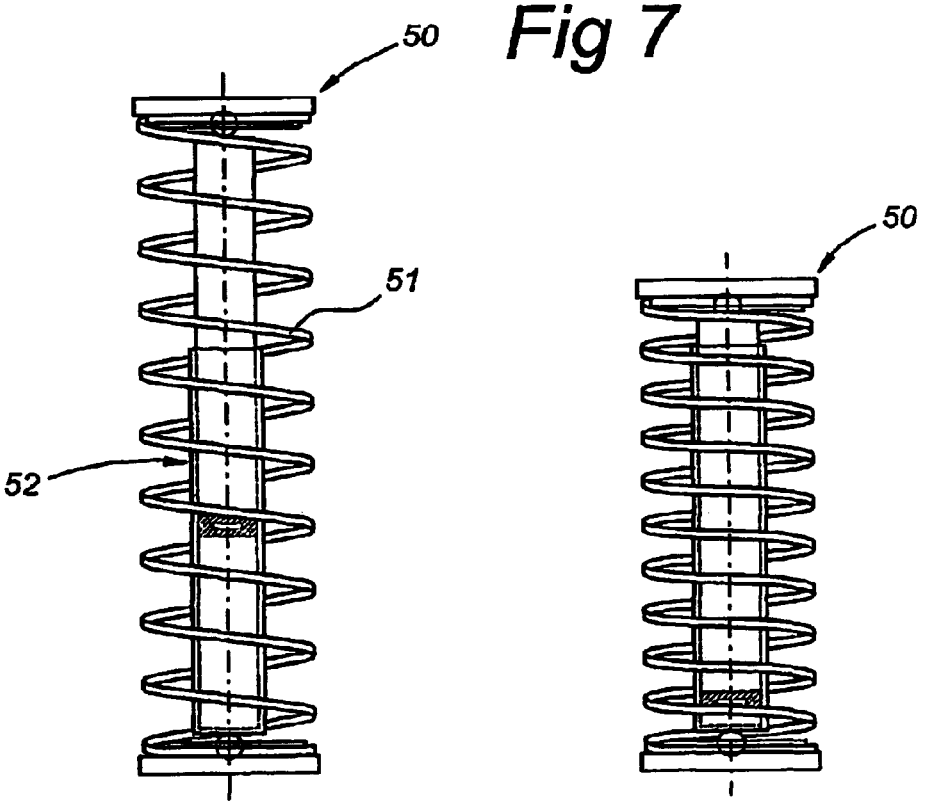
FIG. 7 shows a spring device comprising a shock absorber according to FIG. 6, in an unloaded and a loaded state.

FIG. 7 shows an alternative embodiment of a spring device 50, comprising a coil spring 51 and a shock absorber 52 according to FIG. 6. The spring device 50 is illustrated in the unloaded state on the left in FIG. 7 The same spring device 50 is illustrated in the loaded state on the right in FIG. 7.

Figure 8:
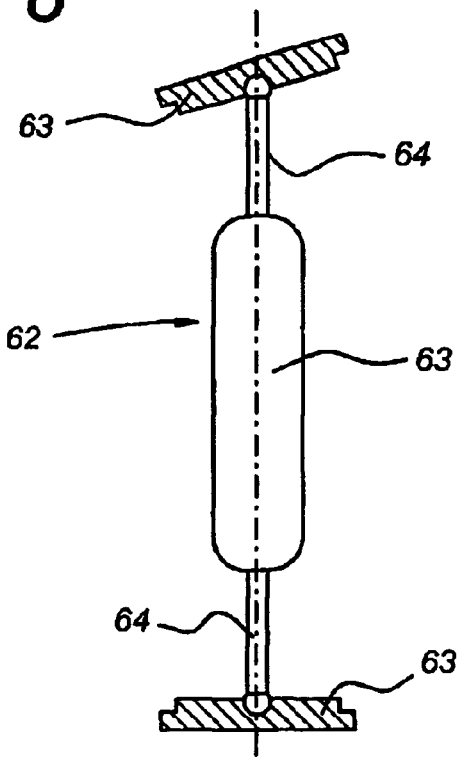
FIG. 8 shows a cross section of a further variant of the shock absorber for use in a spring device according to the invention.

FIG. 8 illustrates a third embodiment of a shock absorber 62. The shock absorber 62 comprises a rubber element 63, which can deform when subjected to load. The rubber element 63 is provided at both ends with a bar or leg 64, which is connected by means of a snap closure to two end elements 63.

Figure 9:
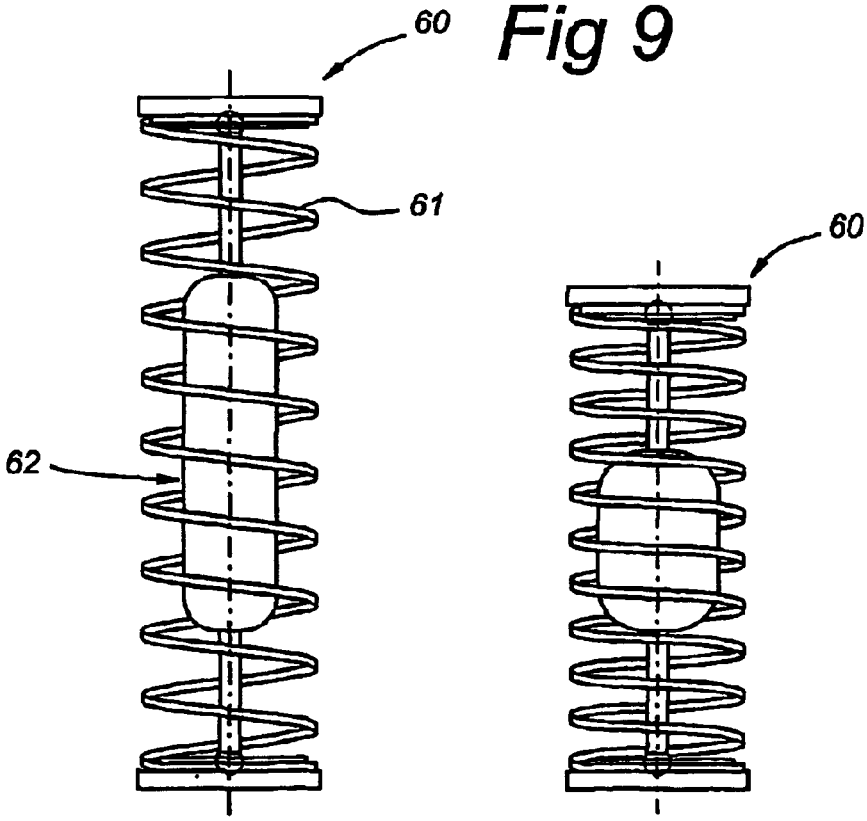
FIG. 9 shows a spring-type device for use in the mattress according to the invention, in an unloaded and a loaded state.

FIG. 9 illustrates a further variant of a spring device 60, composed of the shock absorber 62 according to FIG. 8 and a coil spring 61. The spring device 60 is illustrated in the unloaded state on the left in FIG. 9. The same spring device can be seen in the loaded state on the right in FIG. 9.

As may be seen from the drawings, referring for example to end element 53 as it is shown in FIG. 6 and to rubber element 63 as shown in FIG. 8, the spring devices employed in the practice of the invention can have disc-shaped end elements, if desired.

Furthermore, the end elements can be pivotally attached to the shock absorber, if desired. For example the end elements may pivot about a snap closure, if such is employed, as is shown particularly clearly for the uppermost end elements 53 and 63, in FIGS. 6 and 8, respectively.

What is claimed is:

1. A mattress for use as a bed, the mattress comprising resilient material, spring devices provided in the mattress to distribute pressure exerted upon the mattress, at least two layers placed one on top of the other, blind holes for the accommodation of the spring devices in at least one of said two layers, the blind holes extending through said at least one layer to the boundary between said one layer and another of said at least two layers, wherein each said spring device comprises a coil spring element, a shock absorber operatively connected to said coil spring element and a disc-shaped end element on the end of the coil spring element.

2. Mattress according to claim 1, wherein said shock absorber is in the form of a substantially continuous element of resilient material.

3. Mattress according to claim 1, wherein said shock absorber comprises polyether.

4. Mattress according to claim 1, wherein said shock absorber comprises a rubber element.

5. Mattress according to claim 1, wherein said shock absorber comprises an air cylinder.

6. Mattress according to claim 5, wherein said spring devices are distributed over the mattress, the spring characteristic of the springs varying along the length of the mattress.

7. Mattress according to claim 6, wherein said first layer comprises a first material and the second layer comprises a second material, the first material and the second material differing from each other.

8. Mattress according to claim 1, wherein at least one of the layers comprises slow foam.

9. Mattress according to claim 8, having notches made in the slow foam on the outside of the mattress, which notches extend in one or both of the longitudinal direction or the traverse direction of the mattress.

10. Mattress according to claim 9, notches extend along a length of approximately 40 mm.

11. Mattress according to claim 1, wherein at least one of the layers comprises polyester.

12. A mattress according to claim 1 wherein the coil spring element has two ends and each spring device includes a disc-shaped end element for each end of the coil spring element, the coil spring element being fixed at each end to a respective one of the disc-shaped end elements.

13. Mattress according to claim 12, wherein each said shock absorber is fixed at both ends to the end elements of the spring devices.

14. Mattress according to claim 13, wherein said shock absorber is hingedly connected to at least one of the end elements of the spring devices.

15. Mattress according to claim 1, wherein the spring characteristic of the shock absorber varies along the length of the mattress.

16. A mattress according to claim 1 wherein each end element is pivotally attached to a respective shock absorber.

17. A mattress according to claim 16 wherein the pivotal attachment of each end element to a respective shock absorber is effected by a snap closure and the end element is pivotable about the snap closure.

18. Method for producing a mattress, for use as a bed, the mattress being made of resilient material, and spring devices being fitted in the mattress, in order to distribute the pressure exerted upon the mattress, wherein said mattress is constructed of at least two layers placed one on top of the other, blind holes being made in at least one of the layers, wherein each said spring device comprises a coil spring element, a shock absorber operatively connected to said coil spring element and a disc-shaped end element on the end of the coil spring element and wherein said spring devices are provided in said blind holes, after which said blind holes are covered by a second layer of the mattress.

19. Mattress according to claim 18, wherein blind holes are provided in both a first and a second layer of the mattress, and spring devices are subsequently provided in the blind holes of the first layer of the mattress, the spring devices then being covered by the second layer of the mattress, so that the blind holes of the first layer of the mattress lie in line with the blind holes of the second layer of the mattress.

20. A mattress for use as a bed, the mattress comprising resilient material, spring devices provided in the mattress to distribute pressure exerted upon the mattress, at least two layers placed one on top of the other, blind holes for the accommodation of the spring devices in at least one of said two layers, the blind holes extending through said at least one layer to the boundary between said one layer and another of said at least two layers, wherein said spring devices each comprise a coil spring element and a shock absorber operatively connected to said coil spring element and wherein the shock absorber comprises an air cylinder.

* * * * *